US005197303A

United States Patent [19]

Aria

[11] Patent Number: 5,197,303

[45] Date of Patent: Mar. 30, 1993

[54] NEEDLE SELECTION DEVICE IN A CIRCULAR KNITTING MACHINE WITH ELASTIC JACKS

[75] Inventor: Piero Aria, Florence, Italy

[73] Assignee: Savio S.p.A., Pordenone, Italy

[21] Appl. No.: 766,417

[22] Filed: Sep. 26, 1991

[30] Foreign Application Priority Data

Oct. 5, 1990 [IT] Italy ..... 21646 A/90
Jun. 6, 1991 [IT] Italy ..... MI 91A 001560

[51] Int. Cl.[5] ..... D04B 15/78; D04B 9/00
[52] U.S. Cl. ..... 66/217; 66/232
[58] Field of Search ..... 66/123, 215, 216, 217, 66/218, 219, 220, 232

[56] References Cited

U.S. PATENT DOCUMENTS

| | | | |
|---|---|---|---|
| 3,812,691 | 5/1974 | Engelfried | 66/220 X |
| 3,972,206 | 8/1976 | Mureso | 66/219 |
| 4,715,198 | 12/1987 | Ploppa et al. | 66/232 X |
| 4,739,636 | 4/1988 | Manini | 66/220 |
| 4,905,484 | 3/1990 | Schindler | 66/220 |
| 4,989,424 | 2/1991 | Furia | 66/219 |

FOREIGN PATENT DOCUMENTS

| | | | |
|---|---|---|---|
| 1585206 | 10/1972 | Fed. Rep. of Germany . | |
| 2155808 | 5/1973 | Fed. Rep. of Germany | 66/219 |
| 2424190 | 12/1975 | Fed. Rep. of Germany . | |
| 2436764 | 2/1976 | Fed. Rep. of Germany . | |
| 2030533 | 11/1970 | France . | |
| 2179414 | 11/1973 | France . | |
| 2231791 | 12/1974 | France . | |
| 1165955 | 2/1966 | United Kingdom . | |
| 1257491 | 12/1971 | United Kingdom | 66/219 |

*Primary Examiner*—Andrew M. Falik
*Assistant Examiner*—John J. Calvert
*Attorney, Agent, or Firm*—George P. Hoare, Jr.

[57] ABSTRACT

A device for selecting needles in a circular knitting machine of the elastic jack type, comprising auxiliary jacks positioned below and in the same tricks as the elastic jacks. The auxiliary jacks are selected electromagnetically so that they act to radially lock the elastic jacks while these are in their flexed position within the tricks so that they cannot return outwards and thus engage their raising cams and activate their needle.

13 Claims, 8 Drawing Sheets

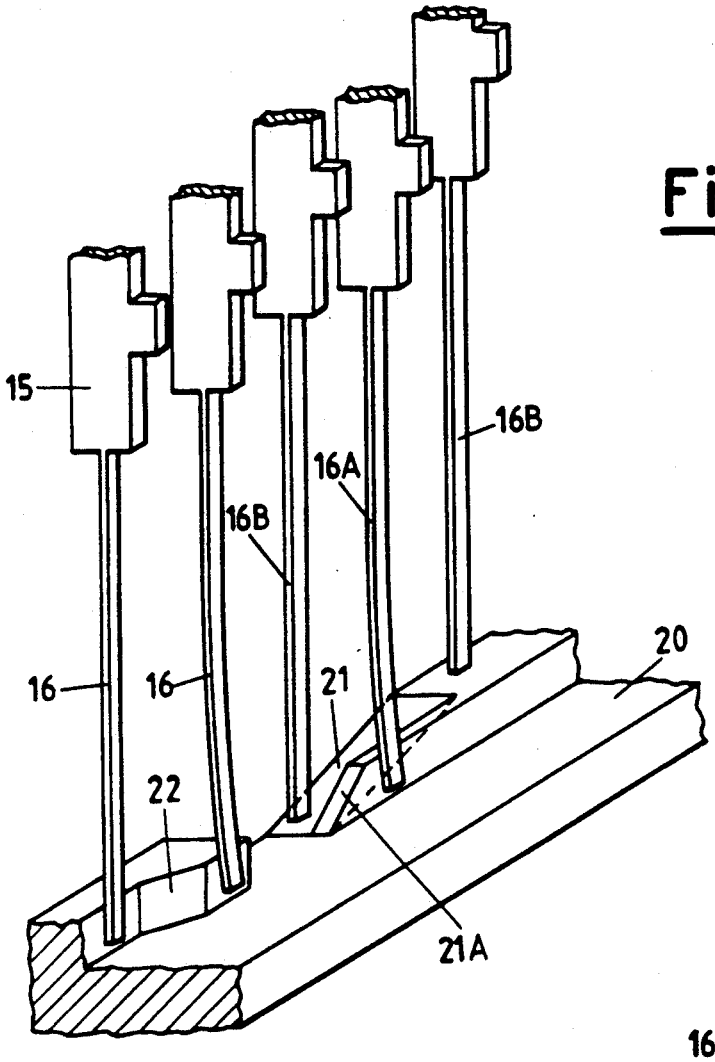
Fig.3C
Fig.4A
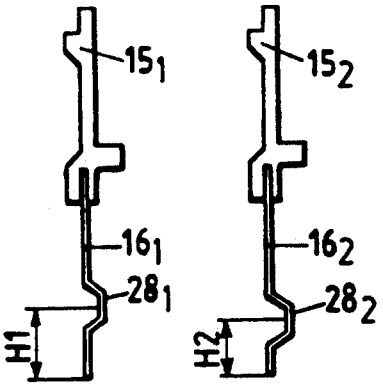
Fig.4B
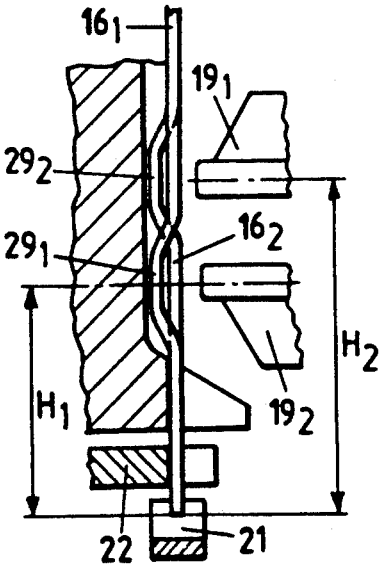

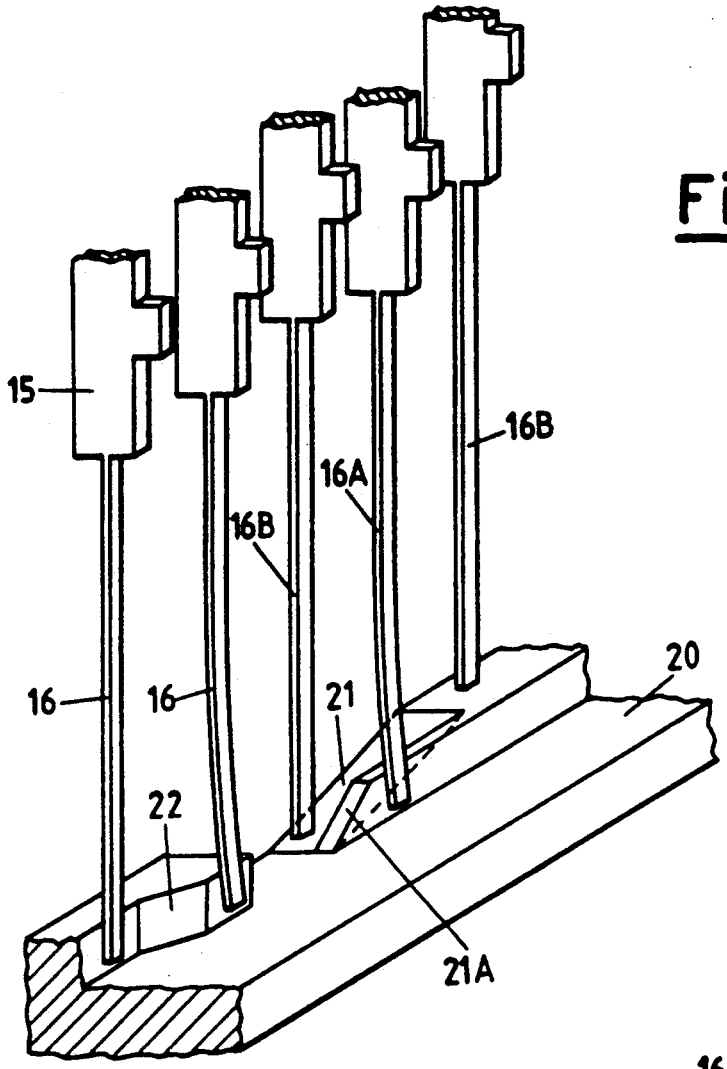
Fig.3C
Fig.4B
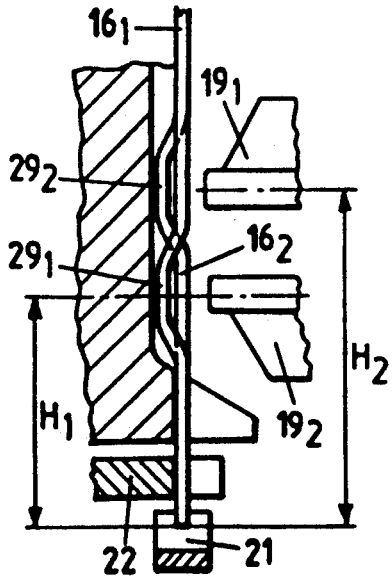
Fig.4A1
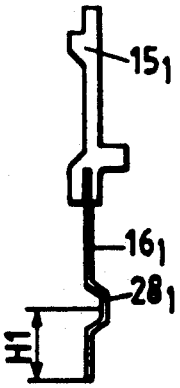
Fig.4A2
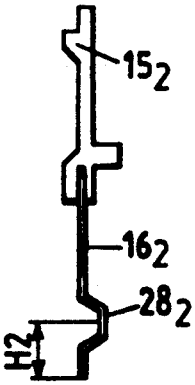

NEEDLE SELECTION DEVICE IN A CIRCULAR KNITTING MACHINE WITH ELASTIC JACKS

BACKGROUND OF THE INVENTION

1. Field of the Invention

This invention relates to circular knitting machines and in particular to the selection of needles in such machines for the purpose of producing patterned knitwork, and provides a device and method for selecting those needles which are to pick up the yarn from the feeds to form knitwear articles.

2. Description of the Related Art

Circular knitting machines are known to consist essentially of one or two needle cylinders which, as shown in FIG. 1, are provided with tricks 1 in their outer cylindrical surface. The tricks represent the guides for the needles 2 which during their travel form the stitch loops in cooperation with the sinkers.

The number of tricks is equal to the number of needles 2 which slide reciprocatingly in them.

Generally, in hosiery machines the number of tricks and needles is between 200 and 400 per cylinder.

The needles operate with reciprocating movement between a maximum position and a minimum position into which they are moved by suitable cams acting on the needle and jack butts.

The cylinder is rotated and with it there rotate the needles which during their reciprocating movement are fed with yarn in an angularly fixed position when in their highest point of travel. To produce hosiery articles generally only part of the available needles are used at the same time and in the same manner, except for the plain knitwork parts, for which all the needles are operated between their maximum and minimum level, all being fed with yarn at each knitting course, and all being moved in the same manner.

When the machine is not producing plain knitwork, in order to produce other types of knitwork (such as mesh or patterned knitwork) some needles are required to produce stitch loops while others have to be raised to an intermediate level to take up yarn without clearing the previous stitch in order to form a tuck stitch, or have to be raised with a certain delay so that they do not pick up the yarn fed into a certain angular position and therefore do not form new loops with it. In other words a needle selection has to be made. This means that for each feed it has to be determined which and how many needles must undergo a certain travel and which and how many other needles must undergo a certain different travel or indeed undergo no travel.

Again with reference to the arrangement shown by way of example in FIG. 1, this selection is made by the jacks 3 which slide in the same tricks 1 as the needles lying above them, to push these latter upwards to a higher level in order to seize the yarn. FIG. 1 shows an elastic jack 3, able to radially inflect its lower end.

The needles 2 are driven reciprocatingly by cams 4 and fixed counter-cams 5 which cause them to move to form the stitch loops. When the jacks 3 have moved the needle into its working position they withdraw from the needle butt and return downwards. If the needle, after completing its task of seizing the yarn and forming the stitch loop and therefore being at its minimum level, is not required to pick up a further yarn from another feed it remains at this level because its control jack remains in its lower rest position.

The jack 3 has a special shape which corresponds to a precise function.

Although not shown on the drawings, it is slightly curved, or bowed, in a direction perpendicular to the plane of FIG. 1. This curvature keeps the jack lightly forced towards the inside of the trick and ensures its accurate positioning and lack of vibration by keeping it properly adhering to the trick walls, but requiring the application of a certain force to move it either axially or radially.

The shank 13 of the jack comprises in its middle part a projection 6, i.e. the upper guide butt, which comes into engagement with its own control cam 7 for urging the jack downwards when it has completed its task of pushing the needle 2.

Proceeding downwards along the jack shank there is a lower butt 8 which comes into engagement with the cam ring 9 provided with a raising contour 10 which raises the jack together with its overlying needle, this therefore being selected to seize the yarn, and with an inner face 11 which causes the elastic jack to approach the interior of the trick.

The lowering cam 7 and the raising and approach contours 10, 11 are obviously offset angularly and operate at different times on each jack.

The elastic jacks 3 tend spontaneously to move their lower butt 8 outwards to engage the raising contour 10 and be raised.

The jacks 3 are maintained in position by one or more circular springs 12 which surround their upper part. The springs themselves are held in position by one or more circumferential grooves in the cylinder, so that the springs lie internal to the face of the needle cylinder. The springs 12 must be sufficiently strong to oppose the forces which flex the shank 13 of the jack so that the flexural forces acting on the lower butt 8 induce said flexure, so that the upper part of the jacks does not leave the tricks. The purpose of the selection mechanism and procedure is to exclude from this totality of jacks the jacks which control those needles which in forming the particular stitch are not required to be raised.

In the known art, as disclosed for example in GB Patent 214,704 and U.S. Pat. No. 4,716,743 the mechanism for selecting or inactivating the needles consists of a plurality of levers or slides which come into contact with a plurality of pattern butts on the lower part of the jack, in an intermediate position between the upper and tower butts 6 and 8, and which urge the jack back into the trick 1 so preventing it making contact with the raising cam 10.

The traditional selection procedure as disclosed in said prior art documents consists of bringing a certain number of slides or levers into contact with a certain number of jacks 3 via the pattern butts located at the same height, by radially moving only some of the slides towards the outer surface of the cylinder. If a determined jack is to be left engaged when one or more of the slides have approached the needle cylinder, the butts corresponding to the height of those levers are removed from the jack. The number of levers or slides available for selection control is generally equal to the number of available pattern butts.

The selection procedures therefore generally consist of producing contact between the non-removed pattern butts of the jacks and the inactivating members, whether levers or slides, by rotating said inactivating members into a position of approach to the cylinder.

Obviously those inactivating members, which are not required to inactivate the jacks whose pattern butts are in a position corresponding with them, are kept in the retracted position at the moment in which they would have made contact.

Needle selection by mechanical devices places very restrictive limits on the machine speed and the possible sequence combinations of needles in their raised position and needles in their lowered position.

Recently proposed solutions are based on electromagnetic selection, using fixed electromagnetic selection devices.

These fixed needle selection devices operate on the jacks which raise the needles into activation when said jacks, during their rotation together with the cylinder, appear in front of the fixed selection station which precedes each machine feed station. The time available for setting, initiating and completing the selection is very small, being of the order of a few thousandths of a second, and determined by the small angular sector within which the rotating jacks face the selection member, which for its part must be immediately ready to select those needles or more precisely those needle jacks which at that moment are presented to them.

Most recently, the solution to the problem has turned towards mobile selection devices rotating together with the cylinder, so that the time available for selection is not limited to the moment in which the jacks appear before the stationary selection device. In this manner each jack is constantly presented to its selection member, so that the selection can take place within a wide angle of the cylinder rotation. In this manner the selection setting time is not so drastically small and the selection can be effected reliably and safely.

In EP Publ. No. 0 379 234 a needle selection is disclosed, which is effected by controlling the radial position of the jacks by means of other horizontal jacks which slide radially. These horizontal jacks are selected by electromagnetic devices, by being caused to assume a position withdrawn from the cylinder to thus allow the corresponding needle to operate, or a position close to the cylinder to thus inactivate the needle.

EP Public. No. 0 441 005 proposes to control the radial position of said horizontal jacks by axially deformable elastic forks which rotate together with the cylinder.

SUMMARY OF THE INVENTION

This invention relates to a device for selecting needles in a circular knitting machine having a needle cylinder. The device comprises a first jack for activating a corresponding needle which is slidably housed in a groove of the cylinder and a first cam adapted for moving the first jack between an active and inactive position. The device also comprises a second jack corresponding to the first jack.

The second jack is slidably housed in the same groove as its corresponding first jack and is adapted for engaging its corresponding first jack when the first jack is to be held in the inactive position. The second jack comprises a rigid portion adapted for moving axially in the groove and a flexible portion adapted for moving axially in the groove and for moving radially with respect to the needle cylinder.

The device further comprises a first contour adapted for radially moving the flexible portion to a radial position and a second contour spaced apart from the first contour adapted for providing the axial movement of flexible portion of the second jack and the engagement with its corresponding first jack. The device also comprises an actuating means interposed between the first contour and the second contour. The actuating means is adapted for retaining the flexible portion in the radial position so that when the first jack is to be activating its corresponding needle, the flexible portion is not engaged by the second contour and the second jack does not axially move and does not engage its corresponding first jack.

BRIEF DESCRIPTION OF THE DRAWINGS

A specific embodiment of the present invention will be described with reference to the following drawings, wherein:

FIG. 3C is a perspective view of the auxiliary jack cooperating with the fixed cam ring;

Figure 6:
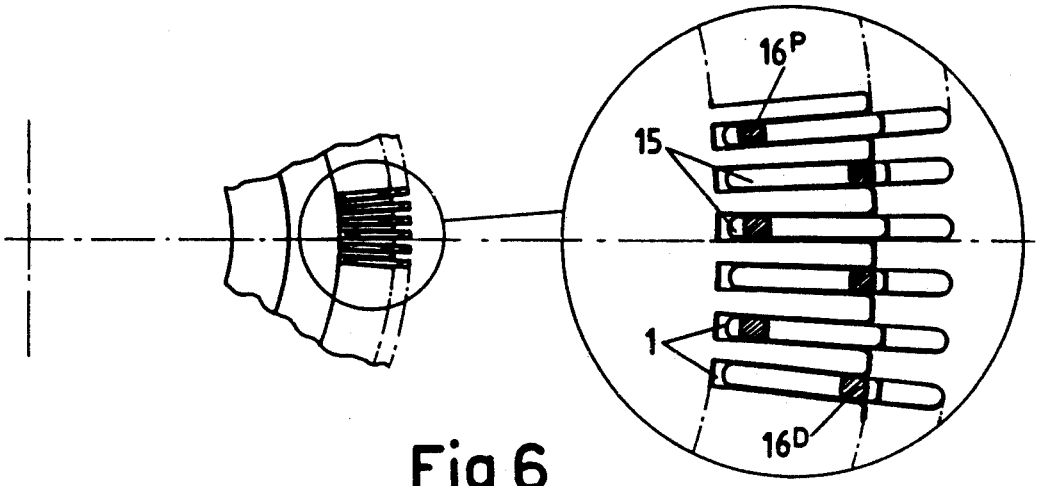
Figure 5:
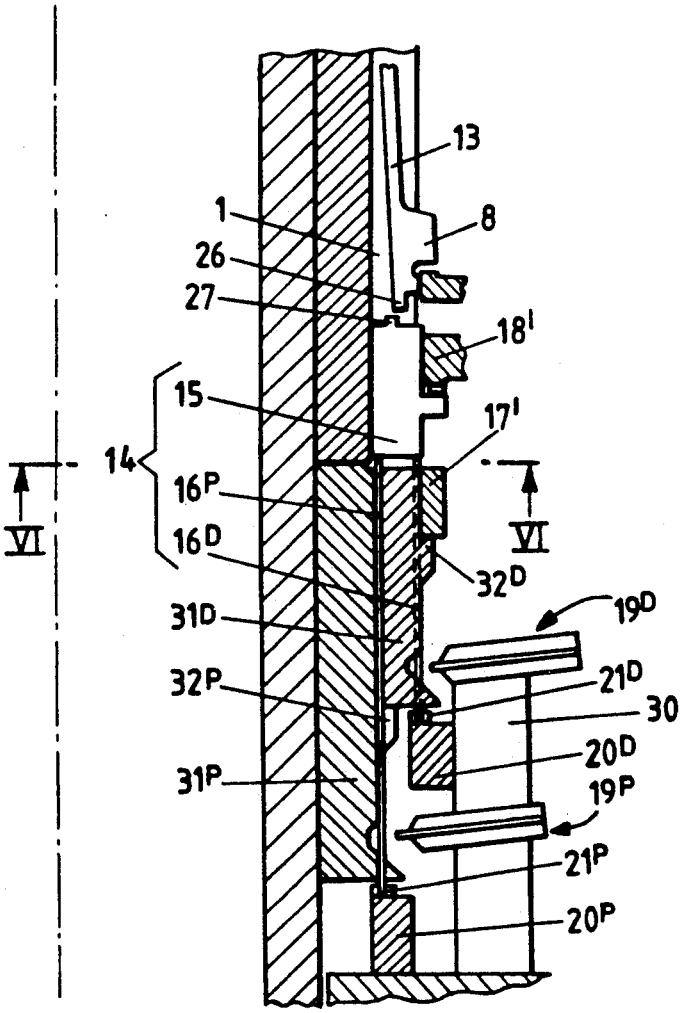
Figure 6A:
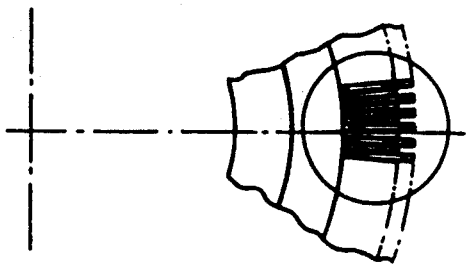
Figure 6B:
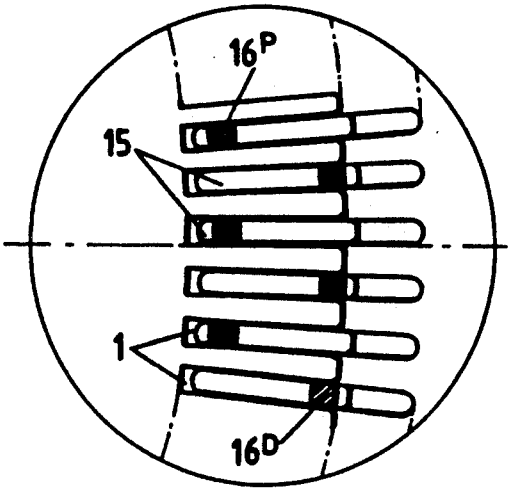
Figure 5:
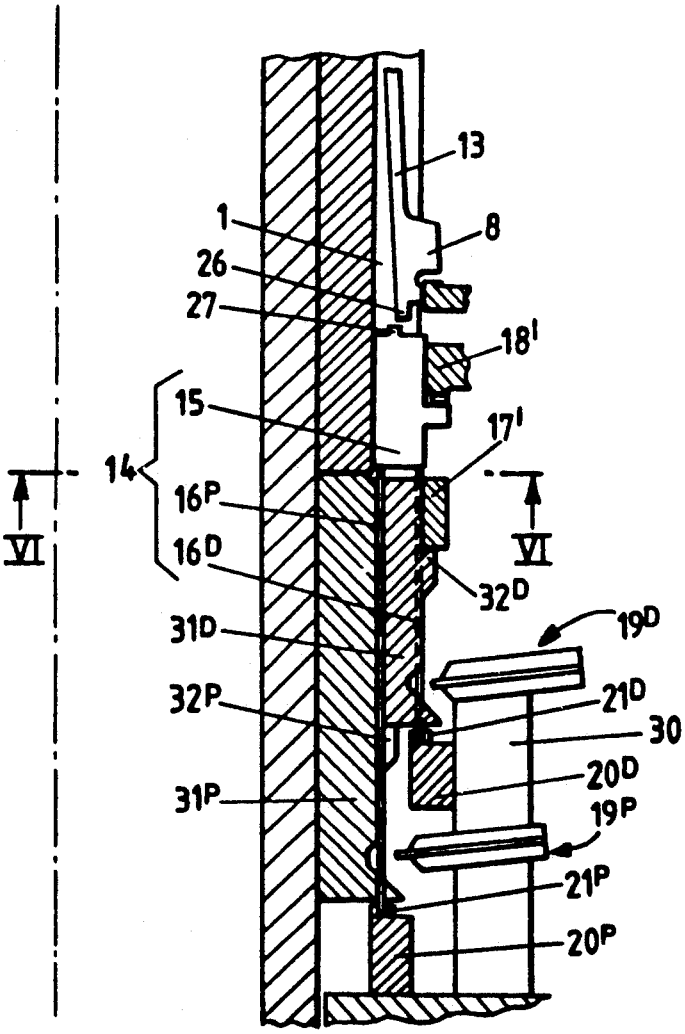

FIG. $4A_1$, is a side view of one shape of another embodiment of the auxiliary jack;

FIG. $4A_2$ is a side view of another shape of the embodiment illustrated in FIG. $4A_1$;

FIG. 4B is a side view of another embodiment of the auxiliary jack;

FIG. 5 is a side view of the stem showing a different configuration;

FIG. 6A is a top view of the configuration shown in FIG. 5;

FIG. 6B is an enlarged view of the configuration shown in FIG. 6A.

The present invention is described hereinafter by way of non-limiting example with reference to FIGS. 2A-2C, 3A-3C, 4A, 4B, 5 and 6. The jack 3 is of special conformation, i.e. in the form of an elastic jack.

Figure 1:
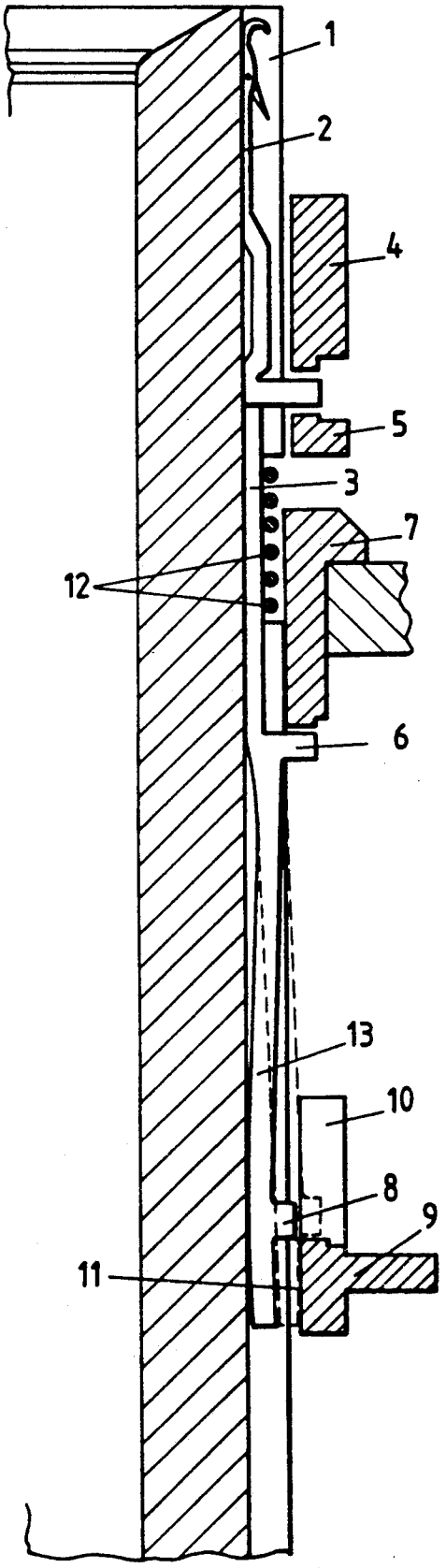
Fig.1 PRIOR ART
FIG. 1 is a side view of a circular knitting machine known in the prior art.
Figure 2A:
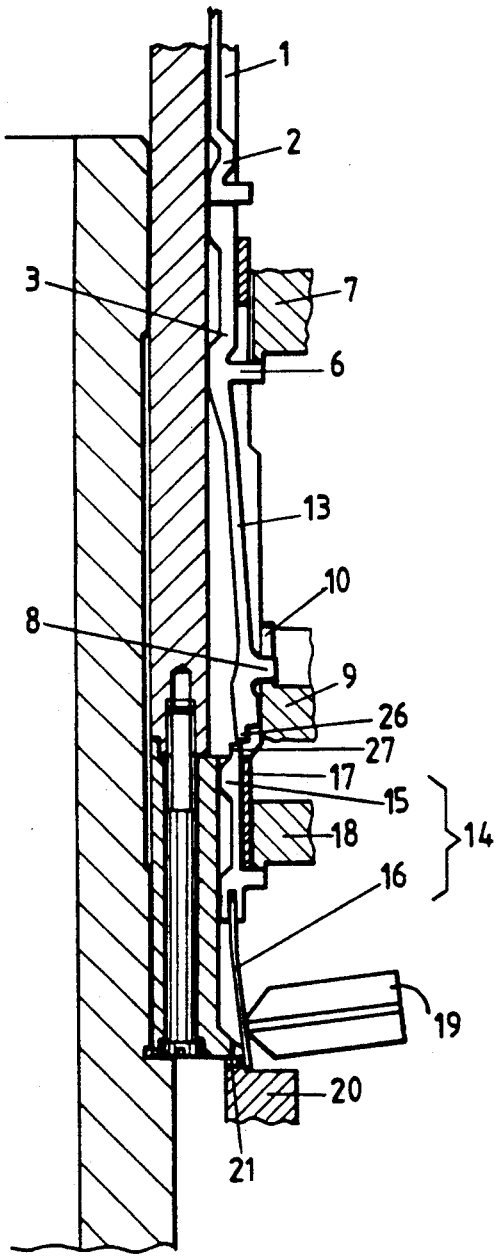
FIG. 2A is a side view of the present invention showing the needle selection in the activation position.
Figure 2B:
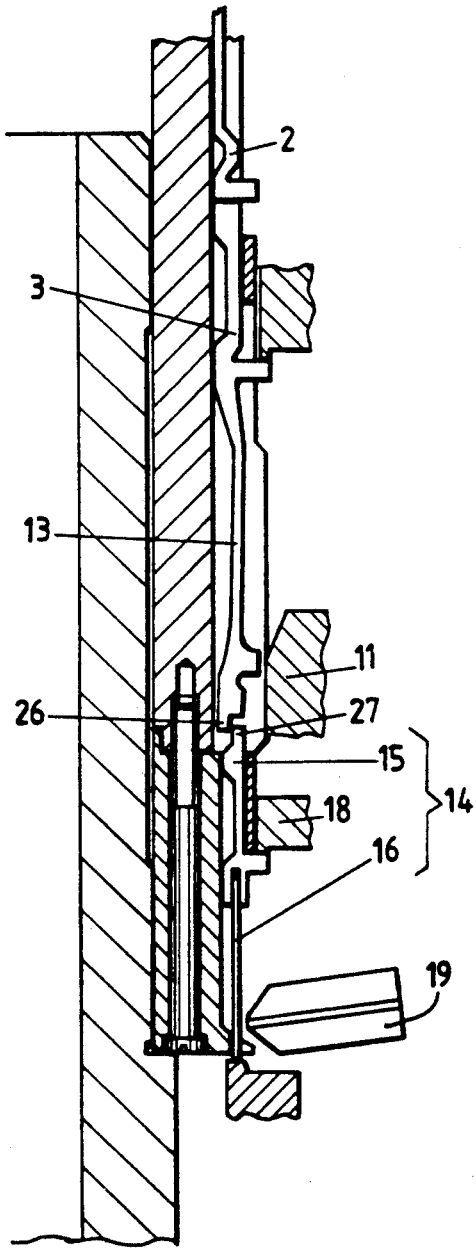
FIG. 2B is a side view of the present invention showing the needle selection in the inactivation position.

In this respect, its shank 13 is made more slender than normal so that it is flexible in the plane of FIGS. 2A and 2B and between a position, shown, in FIG. 2B in which it is flexed by the effect of the radial thrust of the face 11, which urges it into the trick 1 so that it does not engage the raising contour 10 and remains lowered, and a non-flexed or lesser-flexed position, shown in FIG. 2A, in which its butt 8 engages the contour 10 so that the jack is consequently raised.

In contrast to traditional jacks there is no need for radial cams to urge the butt 8 outwards.

The selection device is shown in FIGS. 2A and 2B, of which FIG. 2A shows the device in the selection configuration which activates the needle 2 by raising the jack 3 by means of the contour 10, and FIG. 2B shows the device in the configuration for inactivating the needle 2. Beneath each jack 3 in the same trick 1 there is an auxiliary jack 14. This consists of two parts 15 and 16. The trick portion holding the auxiliary jack 14 can be of different depth, width or profile.

The relatively more rigid upper part 15 can undergo only axial movement, being restrained by the trick 1, the inner ring 17 and the contour of the lowering cam 18. The lower part or stem 16 is however slender and flexible in the plane of the drawing, and is subjected to the action of an electromagnetic selection device 19 cooperating with a fixed cam ring 20, shown in more detail in FIG. 3C consisting of a raising contour 21 and an outward radial withdrawal contour 22, these being angularly offset from each other.

In the embodiment illustrated by way of example in FIGS. 2A and 2B, the auxiliary jack 14 is shown divided into two separately formed parts 15 and 16 connected together by providing in the bottom of part 15 a slot in which the upper end of the lower part of stem 16 is inserted. The retention of the stem 16 can be achieved by other means, however it is essential that any radial force applied to the lower end of stem 16 causes it to flex. This separate formation results in simpler construction. The jack 14 can perform the same function even if of one-piece construction, for example by blanking.

Figure 2C:
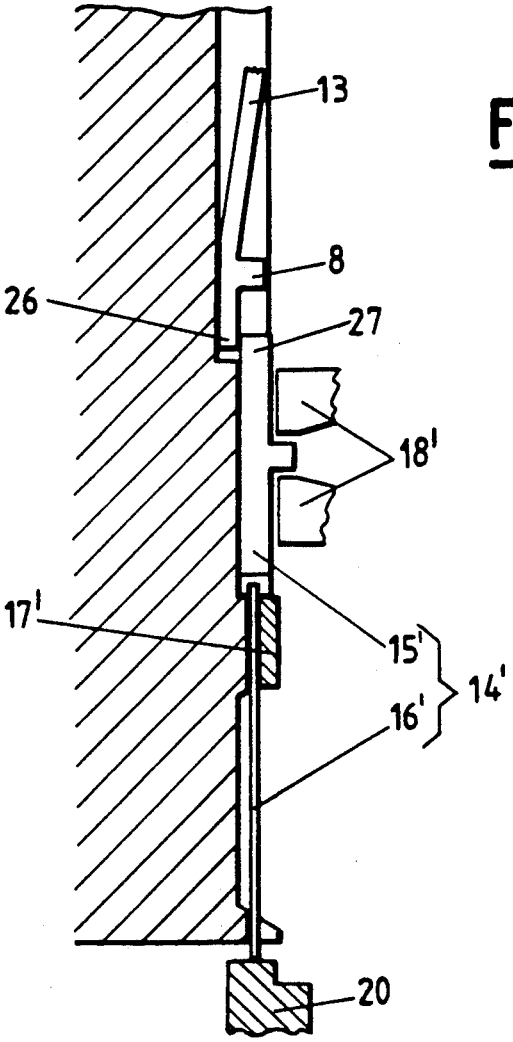
FIG. 2C is a side view of an alternate embodiment of the present invention.

FIG. 2C shows by way of example a different embodiment of the auxiliary jack 14', in which the parts 15' and 16' are axially independent. The cams 18' axially move the upper part 15' acting on a butt of it while the flexible part 16 is retained upperly by the ring 17' so that its lower end flexes by the effect of withdrawal contours 22 on the ring 20, and is free to slide axially within the tricks 1. The electromagnetic selection device 19 consists, in its essential components, of a plate 19A energized by a permanent magnet 23 which permanently attracts into contact with it the stems 16 flexed by the action of the contour 22, and an interposed part 19'' either energized or not energized by an electromagnet 24, in the former case it releasing the stems 16 so that they return to their non-flexed position and are able to rise on the contour 21, and in the latter case retaining them flexed, and away from the next contour 21.

Figure 3A:
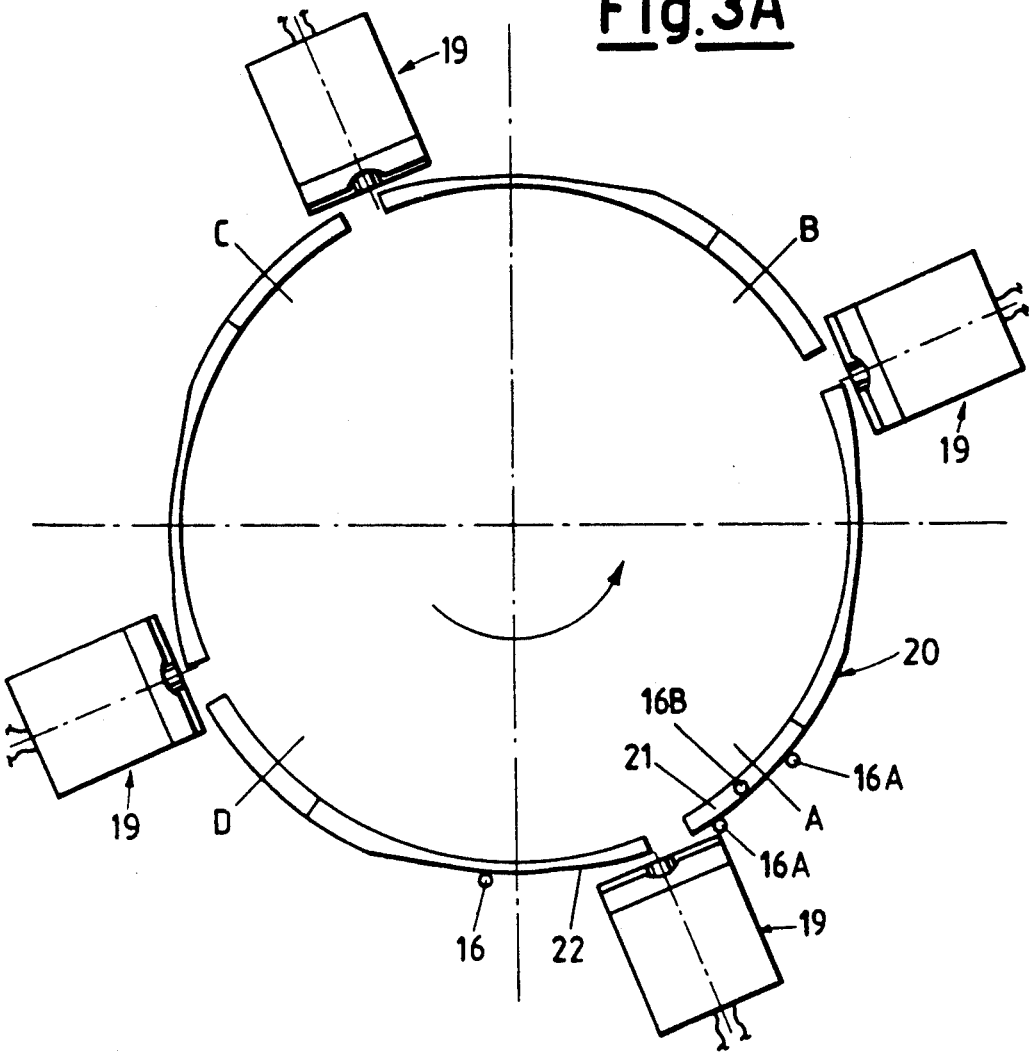
FIG. 3A is a top view of the present invention with four feeds, showing the position of the ring and the electromagnet.
Figure 3B:
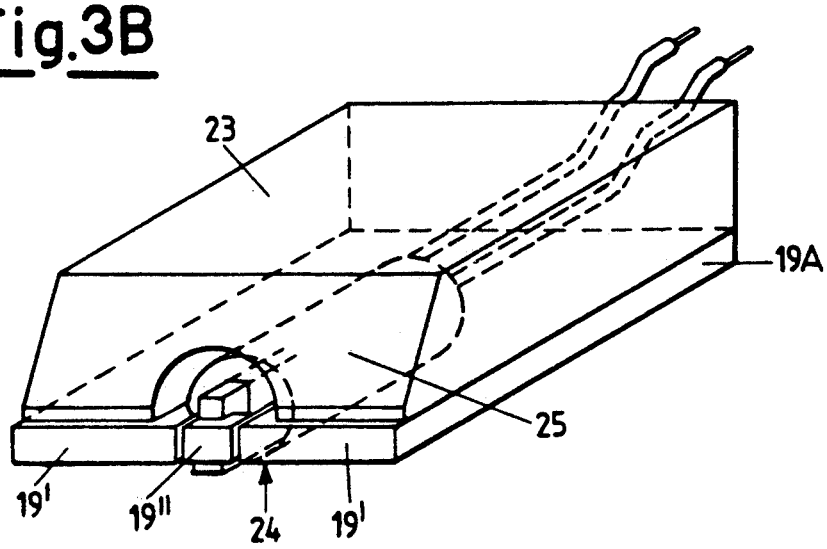
FIG. 3B is a perspective view of the electromagnet of the present invention.

An electromagnetic selection device of this type is already known. With reference to FIGS. 3A-3C'', which show the form and relative position of the ring 20 and devices 19 for an anticlockwise rotating machine with four feeds A, B, C and D, the needle selection is effected as follows.

The stems 16 travel along the ring 20 with anticlockwise movement and reach the withdrawal cams 22 in each feed which flexes them and move them to the face of the devices 19. This happens for all stems 16. The flexed stems 16 travel along the initial part of the plate 19A energized by the permanent magnet 23, remaining in an outwardly flexed position. The contour 22 terminates before the part 19'' of the device 19 energized by the action of the electromagnet 24. FIG. 3B shows the structure of a typical embodiment of the device 19 in greater detail.

It consists of a plate 19A of ferromagnetic material of quadrangular annular shape with an inner cavity containing the electromagnet 24. That edge of the plate 19A which is presented to the stems 16 is divided into two regions, namely an outer region divided into two outer parts 19' connected to the permanent magnet 23, and an inner region 19'' connected to the electromagnet 24 and more specifically to the pole piece of its core, located within the winding 25. The two regions are magnetically separated from each other for example by inserts of diamagnetic material such as brass. In a preferred embodiment of the invention, the plate 19 or at least the edge presented to the stems 16 is protected by an antiwear covering.

The electromagnet device 24 can either be energized to create a magnetic field opposing that of the permanent magnet 23 so that during their passage in front of region 19'' the resultant magnetic attraction on the flexed stems 16 is strongly reduced, their elastic force then causing them to return to a non-flexed position distant from the device 19, or be energized to create a magnetic field in the same sense as that of the magnet 23, so as to maintain the permanent action which retains the stems 16 in a flexed position in contact with the device 19. If the angular aperture of the region 19'' is sufficiently wide, it is sufficient merely not to energize electromagnet 24 to make the elastic force of the stems 16 prevail. If however they have to be retained, the electromagnet 24 must be energized in the same sense as the permanent magnet 23.

If however this aperture is narrow, it is not sufficient merely not to energize electromagnet 24 to release the stems 16 retained in their flexed state. In this case to release the stems 16 the electromagnet 24 must be energized in the opposite sense to the permanent magnet 23.

If a stem 16 is retained in the flexed state it continues its travel in position 16A of FIGS. 3A and 3C. In this respect the second outer part 19' retains it adhering to itself and does not allow it to rise on the raising contour 21 of the ring 20. It continues along the external path resting against the outer face of the cam 21.

However, if a stem 16 is released it continues its travel in position 16B of FIGS. 3A and 3C. It is in a withdrawn state and no longer undergoes substantial attraction by the second outer part 19', so that it is able to rise on the raising contour 21. FIG. 3C shows in greater detail the selection of the stems 16. This takes place by the effect of the region 19'' positioned at the gap between the flexure contour 22 and the raising contour 21 (See FIG. 3A). All the stems 16 are flexed, and the selection is then made at said gap. The stems 16B are released, whereas the stems 16A are retained.

According to a preferred embodiment of the raising cam 21, it is provided with a raised edge 21A which retains the stems 16B on the raising cam 21 and prevents the subsequent rising of any stems 16A which have been imperfectly retained by the device 19. Consequently when the stem 16 rises into the position shown in FIG. 2B, the part upper 15 is raised and prevents the flexible part shank 13 of the jack 3, which has flexed into the trick 1 by the radial thrust of the face 11, from returning outwards at the end of the face 11, by engaging a lower tooth 26 of shank 13 with the upper end 27 of upper part 15 before the action of the face 11 ceases.

The jack 3 can therefore no longer return outwards and engage its butt 8 with the contour 10 to activate the overlying needle 2. In contrast, in the configuration of FIG. 2A the stem 16 of 16A configuration the auxiliary jack 14 does not rise and does not cause the upper part 15 to rise, so that the upper end 27 of the latter does not engage the tooth 26 of shank 13 with the result that when the thrust of the face 11 ceases the shank 13 is freely released and the butt 8 engages the contour 10, causing the jack 3 to rise and activate the needle 2.

On termination of its action by which it locks the jack 3 in the inactivation position, the auxiliary jack 14 is returned downwards by the cam 18, which engages a butt on its upper part 15.

As stated heretofore, in circular knitting machines there is a requirement for high speed and a consequent problem of limited time available for needle selection.

In the device according to the invention, during the time period in which each stem 16 passes in front of the region 19" of the electromagnetic selection device 19, the electromagnet 24 must be energized in the opposite sense to or in the same sense as the permanent magnet 23, or alternatively not be energized, and the stem 16 must have the time, if required, to return to its unflexed position before again entering the angular sector of influence of the second part 19 of the outer of plate 19A.

The present invention has the advantage of allowing variations in the configuration of the stems of the auxiliary jacks so that they can be divided into several series of mutually alternating stems with a consequent in the times and angular spaces available for the selection. There is also a space problem in that the jacks subjected to selection are very close to each other, with a pitch of 1 mm or even less.

FIGS. 4A and 4B show a typical embodiment of the invention with this type of variation. It renders the invention particularly suitable and reliable for high-speed high-productivity machines.

In this preferred embodiment the stems 16 of the auxiliary jacks 14 are shaped differently in the plane of the figure, with at least one projecting part or one recessed part at different heights in adjacent stems, so as to present the appropriate stems in an ordered manner in proximity to their relative electromagnetic selection devices 19, also disposed at different heights, while keeping the adjacent stems distant from those selection devices by which they must not be influenced. In the embodiment of FIG. 4A, the stems $\mathbf{16}_1$ and $\mathbf{16}_2$ are shown by way of example with only two different height values for simplicity. They comprise projections at two levels, the odd numbered stems $\mathbf{16}_1$ having an outwardly projecting part $\mathbf{28}_1$ which makes contact with the corresponding selection device at a height $H_1$, the projecting part $\mathbf{28}_2$ of the even numbered stems $\mathbf{16}_2$, positioned at the height $H_2$, then not being substantially influenced by said selection device. For the same reason the corresponding selection device of these latter, stems $\mathbf{16}_2$ is positioned at the height $H_2$, does not influence the odd stems, coming into contact only with the even stems $\mathbf{16}_2$.

In the embodiment shown by way of example in FIG. 4B, the stems which are not to be influenced by a selection device positioned at a certain height is shaped with an inwardly recessed part at that height, which thus keeps it out of the range of action of that selection device.

In FIG. 4B, the stems $\mathbf{16}_1$ with the recessed part $\mathbf{29}_1$ at the height $H_1$ are selected by the selection device $\mathbf{19}_1$ at the height $H_2$ and they are not influenced by the selection device $\mathbf{19}_2$, from which they are separated by their recessed part $\mathbf{29}_1$. Conversely, the stem $\mathbf{16}_2$, with their recessed part $\mathbf{29}_2$ at the height $H_2$, are selected by the selection device $\mathbf{19}_2$ positioned at the height $H_1$.

A different embodiment comprising variations in stem configuration is shown in FIGS. 5 and 6. This embodiment not only allows higher machine speed and production, but also prevents or considerably limits magnetic interference between adjacent stems.

In this embodiment the stems 16 are shaped with different lengths and are located on circumferences of different radius relative to the upper parts 15 of the auxiliary jacks 14.

In the embodiment of FIGS. 5 and 6 the stems 16 of different configuration alternate mutually, for example those of even number $\mathbf{16}^P$ are longer than and more internal than those of odd number $\mathbf{16}^D$.

The longer and more internal even stems $\mathbf{16}^P$ are selected by the selection device $\mathbf{19}^P$ located in a lower and more internal position, whereas the shorter and more external odd stems $\mathbf{16}^D$ $\mathbf{16}_D$ are selected by the selection device $\mathbf{16}^D$ located in the higher and more external position.

The two selection devices $\mathbf{19}^D$ and $\mathbf{19}^P$ are positioned on a support frame 30.

The stems $\mathbf{16}_D$ and $\mathbf{16}^P$ are guided by concentric grooved ring structures $\mathbf{31}^D$ and $\mathbf{31}^P$, each provided with staggered grooves $\mathbf{32}^D$ and $\mathbf{32}^P$ in a number equal to one half of the tricks 1 provided in the needle cylinder. Specifically, the grooves $\mathbf{32}^D$ are positioned to correspond with the odd numbered tricks 1, whereas the grooves $\mathbf{32}^P$ are positioned to correspond with the even numbered tricks 1. With the stems $\mathbf{16}^D$ there is associated a higher more outer cam ring $\mathbf{20}^D$ provided with a withdrawal contour and a raising contour $\mathbf{21}^D$, these being respectively upstream and downstream of the each selection device $\mathbf{19}^D$. With the stems $\mathbf{16}^P$ there is associated a lower more inner cam ring $\mathbf{20}^P$ likewise provided with a contours withdrawal and a raising contour $\mathbf{21}^P$ upstream and downstream of the even selection devices $\mathbf{19}^P$.

The distance between the circumferences of the even and odd stems can be indicatively 3–6 mm, whereas the pitch between two corresponding adjacent stems is now about 2 mm instead of 1 mm. These distances, associated with the fact that the stems are contained by the ring structures $\mathbf{31}^D$ and $\mathbf{31}^P$, which are preferably constructed of ferromagnetic material, in practice eliminates possible magnetic interference which might otherwise disturb the selection operation.

In providing varying stems 16, the auxiliary jacks 14 can be of one-piece construction, or can be divided into two pieces. This latter design is preferable because of its ease of construction and assembly. This two-level arrangement of the varying stems of the embodiments shown in FIGS. 4A–4B and 5–6 enables the angular width of the space available for needle selection to be doubled.

It is apparent that by providing three, four or more levels in the arrangement of the stems and selection devices this space is correspondingly tripled, quadrupled or multiplied.

I claim:

1. A device for selecting needles in a circular knitting machine having a needle cylinder, comprising:

a) a first jack for activating a corresponding needle, wherein said first jack is slidably housed in a groove of the cylinder;

b) a first cam for moving said first jack between an active and inactive position;

c) a second jack corresponding to said first jack, wherein said second jack is slidably housed in the same groove as corresponding first jack, wherein said second jack engages the corresponding first jack when said first jack is held in said inactive position, and wherein said second jack comprises:

1. a rigid portion for moving axially in the grove; and 2) a flexible portion for moving axially in the groove and for moving radially with respect to the needle cylinder;

d) a first contour for providing said radial movement of said flexible portion to a radial position;

e) a second contour spaced apart from said first contour for proving said axial movement of said flexible portion of said second jack and said engagement with the corresponding first jack; and f) actuation means interposed between said first contour and said second contour for retaining said flexible portion in said radial position so that when said first jack activates a corresponding needle said flexible portion is not engaged by said second contour so that said second jack does not axially move and does not engage the corresponding first jack.

2. The device of claim 1, wherein said actuation means comprises:

a) a ferromagnetic plate having two peripheral members extending opposite one another and a central member therebetween, wherein said central member is separated from said peripheral members by diamagnetic material;

b) a permanent magnet positioned on said plate and connecting said peripheral members for attracting said flexible portion, wherein said permanent magnet has a bore therethrough; and c) an electromagnet operatively associated with said central member for applying magnetic polarity thereto.

3. The device of claim 2, wherein said actuation means further comprises an antiwear covering for reducing wear when cooperating with said flexible portion.

4. The device of claim 3, wherein the profile of said flexible portion of one second jack differs from the profile of said flexible portion of another second jack in the knitting machine.

5. The device of claim 3, wherein said flexible portion of said second jack comprises at least one projection, wherein said projection of said flexible portion of one second jack differs from said projection of said flexible portion of another second jack.

6. The device of claim 3, wherein said flexible portion of said second jack comprises at least one recess, wherein said recess of said flexible portion of one second jack differs from said recess of said flexible portion of another second jack.

7. The device of claim 4, further comprising a plurality of said actuation means, wherein each of said actuation means is selectively located for corresponding with said profile of said flexible portion.

8. The device of claim 3, further comprising a plurality of second jacks having a first length positioned on a first ring structure of the knitting machine and a plurality of second jacks having a second length positioned on a second ring structure of the knitting machine, wherein said first ring structure and said second ring structure are concentric, and further comprising a first cam ring cooperating with said plurality of second jacks having said first length and a second cam ring cooperating with said plurality of second jacks having said second length.

9. The device of claim 8, wherein said plurality of second jacks having a first length and said plurality of second jacks having a second length have profiles which differ one from another.

10. The device of claim 3, wherein said first cam ring and said second cam ring and said actuation devices are located on different levels in the knitting machine.

11. The device of claim 3, wherein said applied magnetic polarity differs from the magnetic polarity of said permanent magnet for releasing said flexible portion attracted by said permanent magnet.

12. The device of claim 3, wherein said applied magnetic polarity is the same polarity as said permanent magnet for attracting said flexible portion.

13. The device of claim 3, wherein said second jack is adapted to engage said first jack for retaining said first jack in said inactive position as said first cam urges said first jack into said inactive position.

* * * * *